United States Patent [19]

Enck, Jr. et al.

[11] 3,934,170

[45] Jan. 20, 1976

[54] IMAGE TUBE AND METHOD AND APPARATUS FOR GATING SAME

[75] Inventors: Richard S. Enck, Jr., Mountain View; James P. Sackinger, San Jose, both of Calif.

[73] Assignee: Varian Associates, Palo Alto, Calif.

[22] Filed: Feb. 11, 1974

[21] Appl. No.: 441,190

Related U.S. Application Data

[63] Continuation of Ser. No. 189,973, Oct. 18, 1971, abandoned.

[52] U.S. Cl. ..... 315/12; 315/16; 250/213 R

[51] Int. Cl.[2] ..... H01J 29/70

[58] Field of Search ..... 315/10–12, 315/16, 30, 31 R; 250/213 R, 213 VT; 313/103

[56] References Cited

UNITED STATES PATENTS

| | | | |
|---|---|---|---|
| 3,499,157 | 3/1970 | Satake et al. | 250/213 VT |
| 3,555,346 | 1/1971 | McGee | 315/12 |
| 3,619,622 | 11/1971 | Pfeiffer | 315/10 |
| 3,708,673 | 1/1973 | Blacker | 250/213 VT |

*Primary Examiner*—Maynard R. Wilbur
*Assistant Examiner*—J. M. Potenza
*Attorney, Agent, or Firm*—S. Z. Cole; D. R. Pressman; R. K. Stoddard

[57] ABSTRACT

In an image tube, a photocathode is disposed to receive a photon image for emitting into the tube a corresponding electron image which is accelerated by an accelerating anode and focused upon an output device, such as a fluorescent screen or a microchannel electron multiplier. A gating electrode is interposed along the beam path between the anode and the output device. The potential difference between the photocathode and the gating electrode is periodically pulsed such that the gating electrode is sufficiently negative relative to the potential of the photocathode for reflecting the image electrons passing through the anode back to the anode for collection thereof and thus for gating off the electron image to the output device. This potential difference may be pulsed by pulsing the photocathode positive with respect to the gating electrode or by pulsing the gating electrode negative with respect to the photocathode.

12 Claims, 2 Drawing Figures

FIG. 1
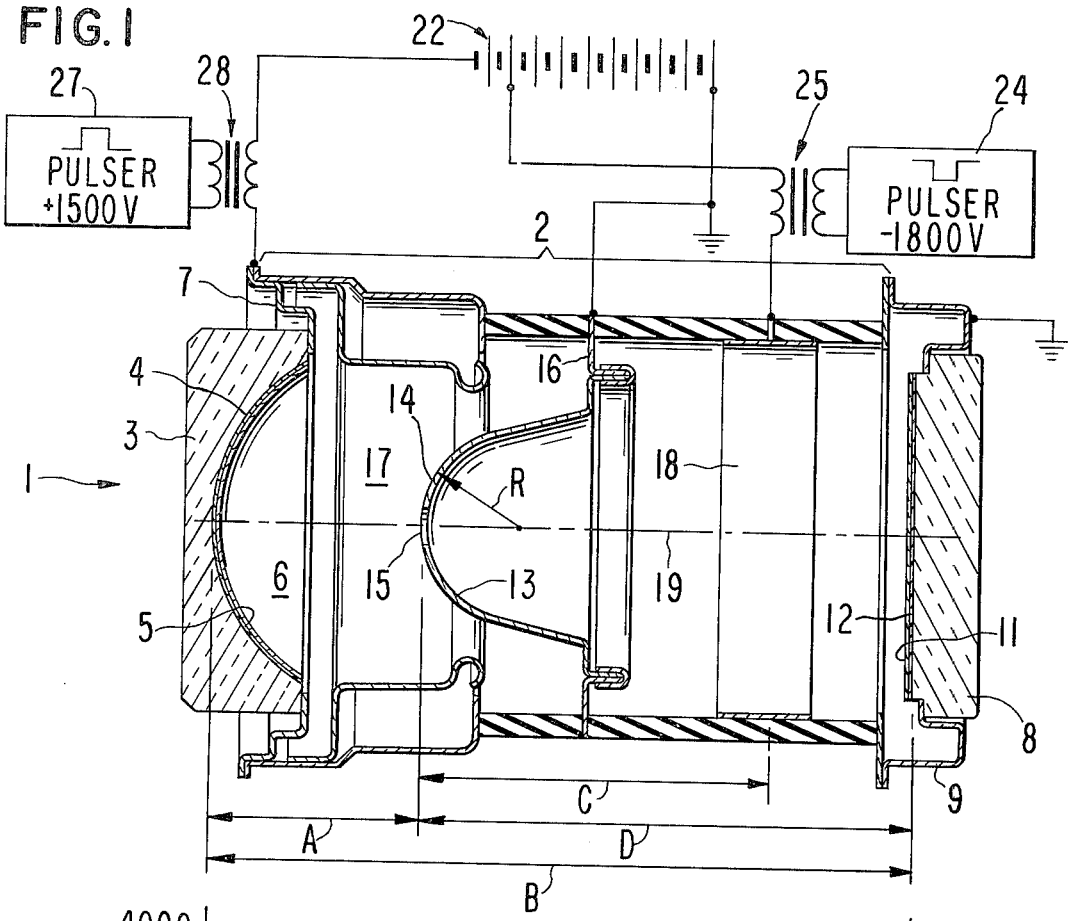
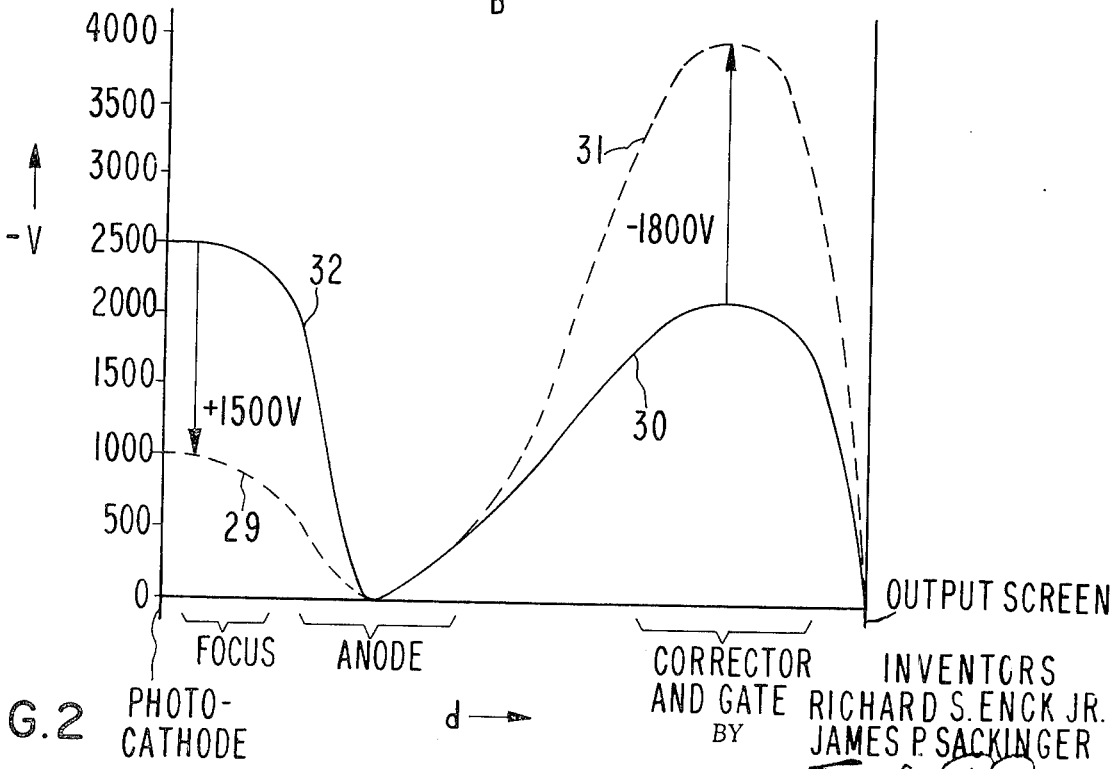
FIG. 2
INVENTORS
RICHARD S. ENCK JR.
JAMES P. SACKINGER
BY

IMAGE TUBE AND METHOD AND APPARATUS FOR GATING SAME

GOVERNMENT CONTRACT

The invention herein described was made in the course of or under a contract with the Department of Defense.

This is a continuation of application Ser. No. 189,973, filed Oct. 18, 1971, now abandoned.

DESCRIPTION OF THE PRIOR ART

Heretofore, it has been proposed to gate on and off the electron image of an image tube by gating on and off a potential applied to a gating electrode interposed between the anode and the photocathode. Such a prior art image tube is disclosed and claimed in U.S. Pat. No. 3,474,275 issued Oct. 21, 1969.

The problem with gating the electron image by means of an electrode interposed between the anode and the photocathode is that such a gating electrode operates by reflecting the electron images back to the photocathode, thereby building up space charge and unwanted capacitive effects. Thus, upon gating on of the electron image, there is a substantial finite recovery time before the space charge and capacitive effects are dissipated to allow the electron image to come into focus at the output screen or device. The capacitive effects are manifested by ringing and overshoot of the gating potential resulting in transient defocusing effects.

It is also known from the prior art for an image tube to employ a distortion corrective electrode between the anode and the output screen of the tube. The distortion corrective electrode is operated at a potential approximately 20% of the cathode-anode voltage more positive than the cathode and serves to alter the electron trajectories of the electron image such that the electrons intercept the output screen at nearly normal angles to the plane of the screen. This corrects for "pin cushion" type distortion in the output image. An image intensifier tube utilizing a distortion corrective electrode is disclosed and claimed in U.S. Pat. application No. 74,058 filed Sept 21, 1970, now abandoned, and assigned to the same assignee as the present invention.

SUMMARY OF THE PRESENT INVENTION

The principal object of the present invention is the provision of an improved image tube and method and apparatus for gating same.

In one feature of the present invention, the image tube includes a gating electrode interposed between the anode and the output device. The potential difference between the gating electrode and the photocathode is pulsed periodically such that the potential of the gating electrode is sufficiently negative with respect to the potential of the photocathode such that the image electrons passing through the anode are reflected back to the anode, thereby periodically gating off the electron image reaching the output device.

Another feature of the present invention is the same as the preceeding feature wherein the potential difference between the gating electrode and the photocathode is periodically pulsed, for gating off the electron image of the tube, by pulsing the potential of the gating electrode negative with respect to the operating potential of the photocathode.

Another feature of the present invention is the same as the first feature wherein the potential difference between the gating electrode and the photocathode is periodically pulsed by periodically pulsing the potential of the photocathode to a potential positive with respect to the potential of the gating electrode.

In another feature of the present invention, the magnification of the image tube falls within the range of 1.2 to 0.8 and the ratio of the axial spacing between the photocathode and the anode to the axial spacing between the photocathode and the output means falls within the range of 0.28 to 0.43.

In another feature of the present invention, the magnification of the image tube falls within the range of 1.2 to 0.8 and the ratio of the axial spacing between the anode and the center of the gating electrode to the axial spacing between the anode and the output means falls within the range of 0.45 to 0.67.

Other features and advantages of the present invention will become apparent upon a perusal of the following specification taken in connection with the accompanying drawings wherein:

BRIEF DESCRIPTION OF THE DRAWINGS

FIG. 1 is a longitudinal sectional view, partly in block diagram form, of an image tube incorporating features of the present invention, and FIG. 2 is a plot of operating potential versus axial distance depicting the potential profile along the beam path from the photocathode to the output screen or output device.

DESCRIPTION OF THE PREFERRED EMBODIMENTS

Referring now to FIG. 1, there is shown an image tube 1 incorporating features of the present invention. Image tube 1 comprises an evacuated tubular envelope 2 closed at the forward end thereof by means of a photon transparent disc-shaped input plate 3, as of glass, having a spherically concave surface 4 facing into the tube 1. An optically transparent electrode 5, as of tin oxide, is deposited over the spherical face 4 and a photocathode layer 6 is deposited overlying the optically transparent electrode 5. The input plate 3 is sealed in a gas-tight manner to the tubular envelope 2 by means of an annular metallic flange 7, which also serves for making electrical contact to the transparent electrode and thus to the overlaying photocathode 6.

An optically transparent disc-shaped plate 8, as of glass, is sealed across the other end of the tubular envelope 2 via the intermediary of an annular metallic flange 9. A cathode ray luminescent screen 11 is deposited over the inside face of the output plate 8. An electron permeable electrode 12, as of aluminum, is deposited over the inside face of the cathode ray luminescent layer 11 for applying a uniform electrical potential over the cathode luminescent layer 11.

An anode electrode 13 is interposed along the beam path between the photocathode 6 and the output screen 12 for accelerating the electron images emitted from the photocathode 6 and for focusing such images upon the cathode ray luminescent output screen 12. The anode 13 has a generally spherical convex face 14 facing the spherical photocathode 6 and a small central circular aperture 15, e.g. 0.10 inch diameter, on the axis of the tube for passing the converged electron images therethrough. The anode electrode 13 has an outwardly flared portion extending rearwardly from the spherical portion and being affixed at its outer end to an anode support ring 16 passing through a tubular dielectric portion of the vacuum envelope 2.

A generally cylindrical focus electrode 17 is interposed along the beam path between the photocathode 6 and the anode 13 to assist in focusing the electron images emitted from the photocathode 6 through the central aperture 15 in the anode 13. The focus electrode 17 is electrically connected to the photocathode for operation at essentially the same potential.

A generally cylindrical gating electrode 18 is deposited on the inside wall of the dielectric envelope 2 in the region along the beam path intermediate the anode 13 and the output screen 12. A contact electrode passes through the envelope for making electrical contact to electrode 18. The spherical photocathode 6, cylindrical focus electrode 17, spherical anode 13, and the cylindrical gating electrode 18 have common axes of revolution such that the axis of revolution for each of the aforementioned electrodes is the central longitudinal axis 19 of the tube 1.

In a typical example of an image tube 1 incorporating features of the present invention, the tube 1 has a magnification falling within the range of 1.2 to 0.8, the ratio of the axial spacing A between the photocathode 6 and the anode 13 to the axial spacing B between the photocathode 6 and the output screen 12 falls within the range of 0.28 to 0.43 and is preferably 0.36. In addition, the ratio of the axial spacing C between the anode 13 and the center of the gating electrode 18 to the axial spacing D between the anode 13 and the output screen 12 falls within the range of 0.45 to 0.67 and is preferably 0.56. The output screen 12 is preferably planar and may comprise a cathode ray luminescent screen as aforecited or some other type of output device such as a microchannel electron multiplier which would have its input face disposed at the position of the cathode ray luminescent screen 12 and an output screen 12 would be disposed adjacent the output face of the microchannel multiplier.

In operation, the anode 13 and the output screen or device 12 are preferably operated at the same potential, such as ground potential. A potential source 22 provides a negative potential, as of −2,500 volts, to the photocathode 6 and focus electrode 17 relative to the anode and screen potential. In addition, the potential source 22 provides a steady state bias potential to the gating electrode 18 which is negative with respect to the anode potential and to the potential of the output screen, and which is preferably within ±20% of the cathode potential for correcting "pin cushion" type distortion of the electron image focused on the output device by causing the electrons to take trajectories which will intercept the plane of the output device 12 at substantially right angles. This is especially important when employing a microchannel electron multiplier as the output device, since if the electrons do not intercept the face of the microchannel array at right angles, some of the electrons pass straight through the array of channels which are canted to the axis 19, producing dark spots on the fluorescent screen which follows the electron multiplier. Thus, in the steady state condition, the gating electrode 18 serves as a distortion corrective electrode.

Image tube 1 is gated off by pulsing the potential difference between photocathode 6 and the electrode 18 in such a way that the potential difference between these electrodes is substantially increased and the potential of the gating electrode 18 is sufficiently negative with respect to the potential of the photocathode 6 such that electron images flowing through the anode are reflected from the gating electrode back to the anode, thereby cutting off the flow of image electrons to the output screen or output device 12.

In a preferred method for pulsing the tube, a pulser 24 is transformer coupled via transformer 25 to the lead supplying the operating potential to the gating electrode 18. Pulser 24 is energized for superimposing a negative pulse, as of −1800 volts, on the d.c. bias of the gating electrode 18 for pulsing the total potential on the gating electrode 18 to approximately −4,000 volts, whereas the photocathode voltage remains at −2,500 volts. This provides an electron mirror in the plane of the gating electrode 18 for reflecting the image electrons back to the anode 13, thereby cutting off the flow of said electrons to the output screen 12.

The advantage to pulsing the gating electrode 18 is that this electrode does not draw current and has negligible capacitance to the other electrodes. Therefore, the pulse power supplied to the electrode via the pulser 24 need only be of a negligible amount, thereby permitting a relatively low power pulser 24 to provide pulses to electrode 18. Moreover, since the capacitance of the gating electrode to the adjacent anode 13 and screen electrode 12 is relatively small, fast rise times on the order of nanoseconds are obtainable without overshoot.

As an alternative to pulsing the gating electrode 18, the photocathode 6 may be pulsed positive with respect to the potential applied to the gating electrode 18, thereby reducing the effective beam voltage and allowing the gating electrode potential, which is now much more negative than the cathode potential, to reflect the image electrons to the anode 13 for gating off the flow of images to the output device. In a typical example, a pulser 27 is coupled to the input lead of the photocathode 6 via transformer 28 for superimposing a positive pulse, as of +1,500 volts, on the d.c. cathode potential for gating off the tube 1. The positively pulsed photocathode 6 produces a potential profile as depicted by dotted line 29 and solid line 30 of FIG. 2, whereas the negatively pulsed gating electrode 18 produces a potential profile as depicted by dotted curve 31 and solid line 32 of FIG. 2.

For the aforecited ratios of dimensions, A/B and C/D, the steady state distortion corrective potential applied to gating electrode 18 should be within ±20% of the photocathode potential, and the anode potential should be within ±30% of the output screen potential, said percentages being percentages of the cathode-to-screen potential, and the radius R of the spherical portion of the anode cone 13 should be within 40–100% of the photocathode radius.

The advantage to the utilization of these ratios and this method of gating the image tube is that low distortion is obtained in the output image as received on the output device 12, such as the fluorescent screen or microchannel array. By lower distortion it is meant that the distortion is less than 2.5% as contrasted with prior overall distortions of 8–20%. Distortion D is defined by the following relation:

$$D = (M_e - M_c)/M_c$$

wherein $M_e$ is the magnification at the edge of the output screen, and $M_c$ is the center magnification at 4% of maximum diameter.

In addition, another advantage is that the electron trajectories as they intercept the output screen 12 have deviations from the normal of less than 5°. Another advantage to the present method of gating as contrasted with the prior art focus grid gating method, where electrons were returned to the photocathode, is that gating is achieved without deleteriously affecting the focus of the image thereby allowing much faster rise and recovery times. In addition, the tube is much less sensitive to deficiencies in the gating pulse, such as ringing and overshoot which could produce, in the prior art method, defocusing effects and unwanted space charge effects.

In other words, the gating method of the present invention provides means for gating the image tube which is independent of focus of the image and much less critical as to the characteristics of the gating pulse. This is important for fast gating pulses of a pulse length less than 1 microsecond and is particularly useful in light ranging systems where it is desired to gate the image tube off for a certain period immediately following the main bang of transmitted light beam to exclude unwanted background and unwanted reflections which could deleteriously effect the tube, due to their high intensity, while permitting observation of targets at a predetermined range.

What is claimed is:

1. In an electron image tube, a photocathode disposed to receive a photon image for emitting into the tube an electron image corresponding to the received photon image, an output means spaced from said photocathode for receiving the emitted electron image, an accelerating anode electrode means interposed between said photocathode and said output means for accelerating and converging the image electrons, said anode means containing a central aperture small compared to said photocathode for passing said converged image electrons from said photocathode and focussing said electron image upon said output means, gating electrode means adjacent said output means for gating the electron image to said output means, said gating electrode means being radially spaced outside said electron image and means for periodically pulsing the potential difference between said gating electrode and said photocathode such that the potential of said gating electrode periodically becomes sufficiently negative with respect to the potential of said photocathode that said image electrons are returned to said anode.

2. The apparatus of claim 1 wherein said photocathode has a generally spherically curved concave emitting surface facing said anode, said anode has a centrally apertured convex surface portion facing said photocathode, said gating electrode has a generally cylindrical electron passageway therethrough, and wherein said photocathode, said accelerating anode, and said gating electrode all have substantially common axes of revolution.

3. The apparatus of claim 2 wherein the magnification of the image tube falls within the range of 1.2 to 0.8 and the ratio of the axial space A between said photocathode and said anode to the axial spacing B between said photocathode and said output means falls within the range of 0.28 to 0.43.

4. The apparatus of claim 2 wherein the magnification of the image tube falls within the range of 1.2 to 0.8 and the ratio of the axial spacing C between said anode and the center of said gating electrode to the axial spacing B between said anode and said output means falls within the range of 0.45 to 0.67.

5. The apparatus of claim 1 wherein said means for periodically pulsing the potential difference between said gating electrode and said photocathode includes, means for periodically pulsing the potential of said gating electrode negative with respect to the operating potential of said photocathode.

6. The apparatus of claim 1 wherein said means for periodically pulsing the potential difference between the gating electrode and said photocathode includes, means for periodically pulsing the potential of said photocathode to a potential positive with respect to the potential of said gating electrode.

7. The apparatus of claim 2 wherein said output means has a generaly planar electron image receiving face facing said accelerating anode.

8. The apparatus of claim 1 including means for applying to said gating electrode a distortion corrective potential which is within ±20% of the operating potential of said photocathode during the period electron images are flowing from said photocathode to said output means.

9. In a method for operating an image tube having a photocathode disposed to receive a photon image and to emit a corresponding electron image over a beam path corresponding to the received photon image, an output means spaced from said photocathode for receiving the emitted electron image, an accelerating anode electrode means interposed between said photocathode and said output means for accelerating and converging the image electrons, said anode means containing a central aperture small compared to said photocathode for passing said converted image electrons from said photocathode and focussing said electron image on said output means, gating electrode means adjacent said output means and spaced radially outside the electron paths, the step of periodically pulsing the potential difference between said gating electrode and said photocathode such that the potential of said gating electrode periodically becomes sufficiently negative with respect to the potential of said photocathode that said image electrons are returned to said anode, thus gating off the electron image to said output means.

10. The method of claim 9 wherein the step of periodically pulsing the potential difference between the gating electrode and the phhotocathode includes the step of, periodically pulsing the potential of the gating electrode negative with respect to the operating potential of said photocathode.

11. The method of claim 9 wherein the step of periodically pulsing the potential difference between the gating electrode and the photocathode includes the step of, periodically pulsing the potential of the photocathode to a potential positive with respect to the potential of said gating electrode.

12. The method of claim 9 including the step of applying a distortion corrective potential to said gating electrode which is within the range of ±20% of the potential of said photocathode during the period electron images are flowing to said output device.

* * * * *